US006026767A

United States Patent [19]

Moroi et al.

[11] Patent Number: 6,026,767

[45] Date of Patent: Feb. 22, 2000

[54] VISCOUS FLUID TYPE HEATER

[75] Inventors: Takahiro Moroi; Takashi Ban; Kenji Takenaka; Kiyoshi Yagi, all of Kariya, Japan

[73] Assignee: Kabushiki Kaisha Toyoda Jidoshokki Seisakusho, Aichi-ken, Japan

[21] Appl. No.: 09/017,088

[22] Filed: Feb. 2, 1998

[30] Foreign Application Priority Data

Feb. 3, 1997 [JP] Japan ..... 9-020499

[51] Int. Cl.[7] ..... F22B 3/06

[52] U.S. Cl. ..... 122/26; 126/247

[58] Field of Search ..... 122/26; 126/247; 237/12.7 R, 12.3 B

[56] References Cited

U.S. PATENT DOCUMENTS 4,427,150 1/1984 Van Basshuysen et al. ..... 237/12.3 B
4,798,176 1/1989 Perkins ..... 122/26
4,974,778 12/1990 Bertling ..... 122/26
5,188,090 2/1993 Griggs ..... 122/26
5,573,184 11/1996 Martin .
5,704,320 1/1998 Ban et al. ..... 122/26

*Primary Examiner*—John A. Jeffery
*Assistant Examiner*—Jiping Lu
*Attorney, Agent, or Firm*—Morgan & Finnegan, L.L.P.

[57] ABSTRACT

A viscous fluid type heater is disclosed. A heat chamber and a heat exchange chamber are disposed closed to each other. The heat chamber accommodates viscous fluid and a rotor that rotates and shears the viscous fluid to generate the heat. The heat is transmitted to the heat exchange chamber thereby circulating fluid passing through the heat exchange chamber is heated. The rotor is made of a first material having a heat conductivity of 100 W/mK.

18 Claims, 2 Drawing Sheets

VISCOUS FLUID TYPE HEATER

BACKGROUND OF THE INVENTION

The present invention relates to a viscous fluid type heater that generates heat by shearing viscous fluid in a heating chamber with a rotor and transmits the generated heat to heat exchange fluid in a heat exchange chamber.

The present assignee has proposed various types of engine-driven viscous fluid type heaters that function as auxiliary heat sources for vehicles. Such heaters typically include a housing, a heating chamber and a water jacket (a heat exchange chamber), which are defined in the housing. The heaters also include a disk-shaped rotor coupled to and driven by an engine with a drive shaft. When rotated, the rotor shears viscous fluid (for example, silicone oil having a high viscosity) thereby generating heat based on fluid friction. The heater uses the generated heat to heat circulating fluid (engine coolant) in the water jacket.

The disk-shaped rotor causes the relative speed between the disk and the fluid to be higher in the peripheral portion of the rotor. In other words, the fluid is sheared by a faster moving disk surface in the peripheral portion of the rotor compared to the fluid at the center portion of the disk. This causes the temperature of the viscous fluid at the rotor periphery to be higher than that of the fluid near the rotor center. If viscous fluid is heated to exceed its maximum heat resistance, the fluid quickly deteriorates. Deteriorated fluid fails to generate heat when sheared. Thus, localized deterioration of viscous fluid occurs in viscous fluid heaters having a disk-shaped rotor and the like.

When a viscous fluid type heater is operating, heat generated in the heating chamber causes the drive shaft and the rotor to expand. In order to maintain the connection between the rotor and the drive shaft under such circumstances, the rotor is typically made of the same material as the drive shaft (for example, carbon steel, which has heat conductivity of 35 to 60 W/(m·K)). However, carbon steel is difficult to machine. Also, carbon steel is relatively heavy and thus increases the weight of the heater.

SUMMARY OF THE INVENTION

Accordingly, it is an objective of the present invention to provide a viscous fluid type heater that prevents viscous fluid from being deteriorated by excessive heat and thus maintains the heat generating capacity. It is another objective of the present invention to provide a viscous fluid type heater that includes a rotor made of a light and easy-to-machine material.

Other aspects and advantages of the invention will become apparent from the following description, taken in conjunction with the accompanying drawings, illustrating by way of example the principles of the invention.

To achieve the above objectives, a viscous fluid type heater is disclosed. The heater has a heat chamber and a heat exchange chamber disposed close to the heat chamber. The heat chamber accommodates viscous fluid and a rotor that rotates and shears the viscous fluid to generate the heat. The heat is transmitted to the heat exchange chamber thereby circulating fluid passing through the heat exchange chamber is heated. The rotor is made of a first material having a heat conductivity of at least 100 W/mK.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS

An embodiment of the present invention will now be described with reference to FIGS. 1 and 2.

Figure 1:
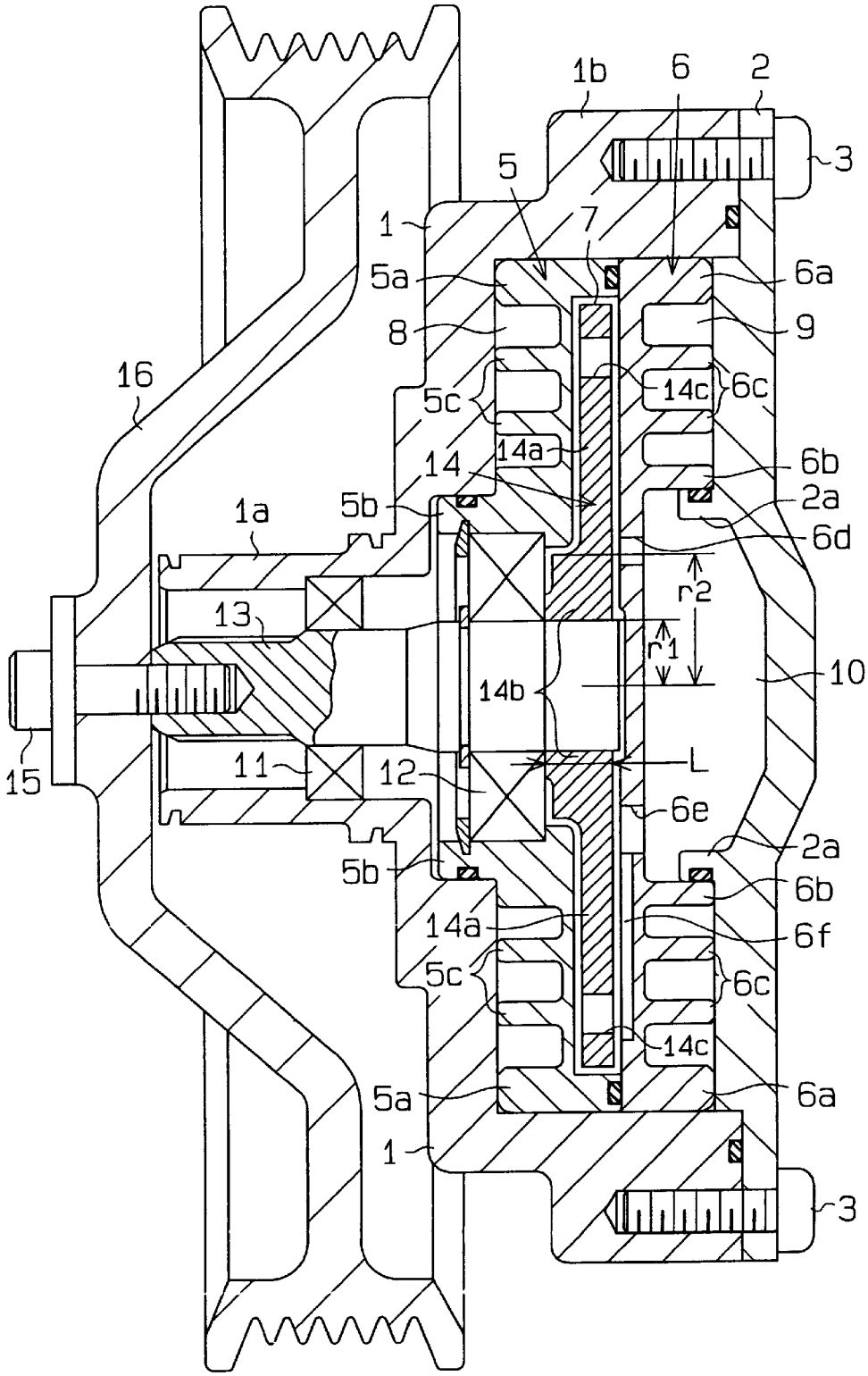
FIG. 1 is a cross-sectional view illustrating a viscous fluid heater according to one embodiment of the present invention.

In FIG. 1, the left side is defined as the front side of the heater and the right side is defined as the rear side of the heater. As shown in FIG. 1, the heater includes a front housing body 1 and a rear housing body 2. The front housing body 1 has a hollow cylindrical boss 1*a*, which protrudes forward, and a bowl-like cylinder 1*b*, which extends rearward from the proximal end of the boss 1*a*. The rear housing body 2 serves as a lid for covering the opening of the cylinder 1*b*. The front housing body 1 and the rear housing body 2 are fastened to each other by bolts 3. A front dividing plate 5 and a rear dividing plate 6 are accommodated in a space defined between the housing bodies 1, 2. The housing of the heater is thus constituted by the front housing body 1, the rear housing body 2, the front dividing plate 5 and the rear dividing plate 6.

The plates 5, 6 have peripheral rims 5*a*, 6*a*. The rims 5*a*, 6*a* are secured between the end walls of the housing bodies 1, 2. A recess is formed in the rear face of the front dividing plate 5. The recess and the front face of the rear dividing plate 6 define a heating chamber 7 between the plates 5 and 6.

The front dividing plate 5 includes a cylindrical wall 5*b* extending forward from the center portion of its front face and fins 5*c* extending circularly about the cylindrical wall 5*b*. The front dividing plate 5 is located in the front housing body 1 with the cylindrical wall 5*b* press fitted into a recess (unnumbered) formed in the inner wall of the housing body 1. The inner wall of the front housing body 1 and the front face of the dividing plate 5 define an annular front water jacket 8. The water jacket 8 is located about the cylindrical wall 5*b* and adjacent to the heating chamber 7, and functions as a heat exchange chamber. The rim 5*a*, the cylindrical wall 5*b* and the fins 5*c* define channels for the circulating water.

As shown in FIG. 1, the rear dividing plate 6 includes a cylindrical wall 6*b* extending rearward from the central portion of its rear face and fins 6*c* extending circularly about the cylindrical wall 6*b*. The rear dividing plate 6 is fitted in the front housing body 1 with the cylindrical wall 6*b* contacting another cylindrical wall 2*a* formed on the front face of the rear housing body 2. The inner wall of the rear housing body 2 and the rear face of the rear dividing plate 6 define an annular rear water jacket 9. The water jacket 9 is located adjacent to the rear end of the heating chamber 7. The cylindrical wall 6*b* and the central inner wall of rear housing body 2 define a sub-oil chamber 10. The rim 6*a*, the cylindrical wall 6*b* and the fins 6*c* define channels for the circulating water.

The front housing 1 includes inlet ports (not shown) and outlet ports (not shown) on a side. The inlet ports draw circulating water to the water jackets 8, 9 from a heating circuit (not shown) of the vehicle, whereas the outlet ports discharge circulating water from the water jackets 8, 9 to the heating circuit.

As shown in FIG. 1, a drive shaft 13 extends through the front housing body 1 and the front dividing plate 5 and is rotatably supported by a bearing 11 and a seal bearing 12. The seal bearing 12 is located between the cylindrical wall 5*b* and the drive shaft 13 for sealing the front end of the heating chamber 7.

The heating chamber 7 houses a disk-shaped rotor 14. The rotor 14 includes a disk 14*a* and a boss 14*b* located in the center of the disk 14*a*. The boss 14*b* has a hole formed in its center for receiving the shaft 13. The rotor 14 is press fitted to the drive shaft 13 to integrally rotate with the shaft 13. The disk 14*a* has a uniform thickness. The boss 14*b* is thicker than the disk 14*a* and is flush with the disk 14*a* on the rear face of the rotor 14. The boss 14*b* thus protrudes forward from the disk 14*a*. The radius of the hole in the boss 14*b* is represented by r1 and is substantially equal to the radius of the drive shaft 13. The radius of the boss 14*b* is represented by r2. The radial thickness of the boss 14*b* is therefore represented by r2−r1. If the axial thickness L of the boss 14*b* is equal to r1 (L=r1), the radial thickness (r2−r1) of the boss 14*b* is determined by multiplying r1 by 0.9 to 1.2.

The front side of the rotor 14 communicates with the rear side of the rotor 14 by bores 14*c* formed in the peripheral portion of the rotor 14. The bores 14*c* are all located at the same distance from the axis of the drive shaft 13 and are spaced apart at equal angular intervals about the axis of the shaft 13.

The rear dividing plate 6 includes an upper recovery bore 6*d* and a lower supply bore 6*e* for communicating the heating chamber 7 with the sub-oil chamber 10. The front face of the plate 6 includes a radial groove 6*f*. The cross-sectional area of the supply bore 6*e* is larger than that of the recovery bore 6*d*.

The heating chamber 7 and the sub-oil chamber 10 are communicated by the bores 6*e*, 6*d* and thus function as a fluid-tight inner space in the heater housing. The inner space accommodates a predetermined amount of silicone oil, which is a viscous fluid. The amount of the silicone oil is determined such that the fill factor of the oil is fifty to eighty percent relative to the volume of the inner space at room temperature. Despite the relatively low fill factor of the silicone oil, the high viscosity of the silicone oil causes rotation of the rotor 14 to draw the silicone oil out of the sub-oil chamber 10 and to evenly distribute the oil in the space between the rotor 14 and the wall of the heating chamber 7. The level of the silicone oil in the sub-oil chamber 10 is lower than the recovery bore 6*d* and higher than the supply bore 6*e*.

The front end of the drive shaft 13 is secured to a pulley 16 by a bolt 15. A V-belt (not shown) is engaged with the periphery of the pulley 16. The V-belt operably couples the pulley 16 with an external drive source such as a vehicle engine.

The operation of the above heater will now be described.

When the engine is not running, in other words, when the drive shaft 13 is not rotating, the level of silicone oil in the heating chamber 7 is equal to the level of the silicone oil in the sub-oil chamber 10. Therefore, when the drive shaft 13 starts rotating, the contact area between the rotor 14 and the silicone oil is relatively small. This allows the pulley 16, the drive shaft 13 and the rotor 14 to be driven by a small torque. When the engine is running, the drive force of the engine is transmitted to the pulley 16 by the belt and rotates the pulley 16. The pulley 16 rotates the drive shaft 13 and the rotor 14. The rotor 14 shears the silicone oil between the wall of the heating chamber 7 and the rotor 14. This heats the silicone oil. Heat exchange then takes place between the heated silicone oil and the circulating water in the water jackets 8, 9. The heated water warms the passenger compartment as it flows through the heating circuit (not shown).

Rotation of the rotor 14 causes the silicone oil to flow toward the drive shaft 13 because of the Weissenberg effect. Thus, the silicone oil in the heating chamber 7 is returned to the sub-oil chamber 10 through the upper bore 6*d*. On the other hand, due to its high viscosity and own weight, the silicone oil in the sub-coil chamber 10 is drawn to the heating chamber 7 by rotation of the disk 14 through the lower bore 6*e* and via the groove 6*f*.

As described above, rotation of the rotor 14 causes silicone oil to circulate between the heating chamber 7 and the sub-oil chamber 10. Since the lower bore 6*e* has a larger diameter than that of the upper bore 6*d*, the amount of oil supplied to the heating chamber 7 exceeds the amount of oil recovered to the sub-oil chamber 10. Therefore, silicone oil stored in the sub-oil chamber 10 is quickly supplied to the peripheral portion of the heating chamber 7. The Weissenberg effect quickly moves the silicone oil in the peripheral portion to the center portion of the heating chamber 7. The silicone oil is therefore evenly distributed in the space between the rotor 14 and the wall of the heating chamber 7.

After returning from the heating chamber 7 to the sub-oil chamber 10, silicone oil stays in the sub-oil chamber 10 for a certain period. Immediately after silicone oil enters the sub-oil chamber 10 from the heating chamber 7, the temperature of the oil is high. Part of the heat however is transmitted to the rear dividing plate 6. This lowers the temperature of the silicone oil. Accordingly, the silicone oil is prevented from being damaged by high temperature over a prolonged period.

The rotor 14 of this embodiment is made of a material having relatively high heat conductivity. The following is a description of materials that may be used for the rotor 14. The heat conductivity T (W/(m·K)) of the following materials are cited from vol. B4 ("Material Science") of the "Mechanical Engineering Handbook" edited by the Japan Society of Mechanical Engineers.

Materials having high heat conductivity include aluminum alloys and copper alloys. Preferred aluminum alloys include: industrial pure aluminum (e.g., Japanese Industry Standard (JIS) number A1100-H18, which is 99% by weight or more of aluminum and which has a heat conductivity T of 222 W/(m·K)); duralumin (e.g., JIS number A2017-T4, which chiefly consists of aluminum and includes 4.0% by weight of copper, 0.6% by weight of magnesium, 0.5% by weight of silicon and 0.6% by weight of manganese, T=201 W/(m·K)); aluminum foundry alloy (e.g., JIS number AC4CH-T6, which chiefly consists of aluminum and includes 7.0% by weight of silicon, 0.3% by weight of magnesium, T =151 W/(m·K)); and aluminum die-cast alloy (e.g., JIS number ADC12, which chiefly consists of aluminum and includes 11% by weight of silicon and 2.5% by weight of copper, T=100W/(m·K). Preferred copper alloys are ones having 99.9% by weight or more of copper. Specifically, the preferred copper alloys include oxygen free copper (e.g., JIS number C1020, T=384 W/(m·K)) and tough pitch copper (e.g., JIS number C1100, T=384 W/(m·K)). The above copper alloys have relatively high heat conductivities and thus rapidly equalize the temperature in the heating chamber 7. On the other hand, the above aluminum alloys are relatively light and soft. In other words, a rotor 14 made of aluminum alloy is light and easy to machine.

Figure 2:
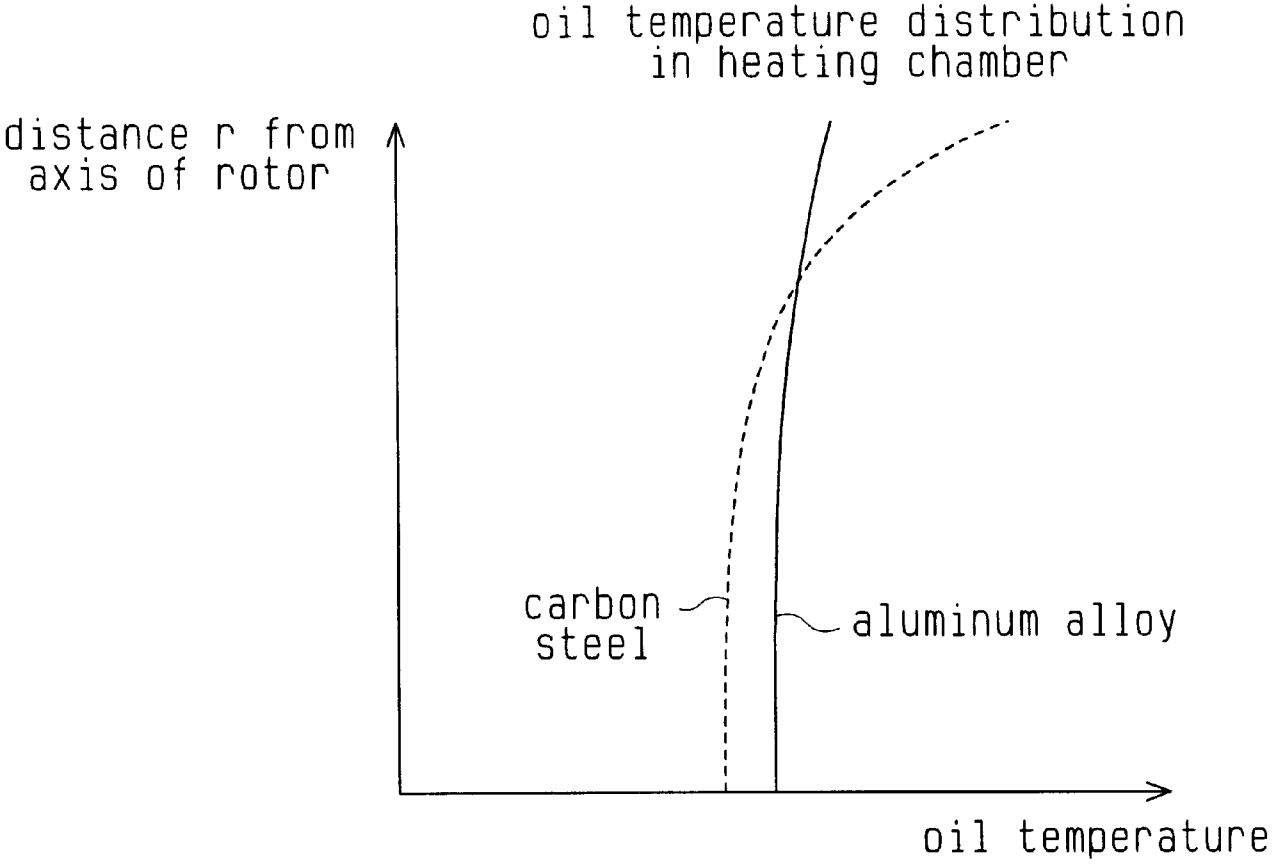
FIG. 2 is a graph showing temperature distribution of silicone oil in a heating chamber.

The graph of FIG. 2 shows the distribution of oil temperature in the heating chamber 7 when the rotor 14 is made of carbon steel and when the rotor 14 is made of aluminum alloy. As shown in the graph, if the rotor 14 is made of carbon steel, which has a relatively low heat conductivity, the temperature in an area near the axis of the rotor 14 (the central portion of the heating chamber 7) is significantly lower than the temperature in an area far from the axis of the rotor 14 (the peripheral portion of the heating chamber 7). However, if the rotor 14 is made of aluminum alloy, which has a greater heat conductivity than carbon steel, the temperature difference between the central portion and the peripheral portion of the heating chamber 7 is small. This is because a rotor 14 made of aluminum alloy functions as an efficient heat conductor and transmits heat in the peripheral portion to the central portion thereby equalizing the temperature of silicone oil in the heating chamber 7.

The viscous fluid heater described above has the following advantages.

Rotation of the drive shaft 13 and the rotor 14 causes the temperature of silicone oil in the peripheral portion of the heating chamber 7 to be higher than the temperature of silicone oil in the central portion of the heating chamber 7. However, the rotor 14 according to this embodiment is made of a material having a high heat conductivity. The rotor 14 therefore functions as a heat conductor and reduces the heat in the peripheral portion of the heating chamber 7. The rotor 14 ultimately decreases the temperature gradient of silicone oil in the radial direction of the rotor 14. Thus, the temperature of the silicone oil does not increase excessively in specific areas (in particular, the peripheral portion of the heating chamber 7). In other words, the silicone oil is not heated to exceed its maximum heat resistance. In this manner, the rotor 14, which is made of a material having high heat conductivity, prevents the silicone oil from prematurely degrading because of excessive heat. This extends the life of the viscous fluid heater.

Since the rotor 14 is made of aluminum alloy, the rotor 14 is relatively easy to machine compared to a rotor made of carbon steel. Also, the rotor 14 is relatively light. Specifically, the aluminum rotor 14 weighs one third the weight of a rotor made of carbon steel.

The drive shaft 13 is made of carbon steel and has a coefficient of thermal expansion that is smaller than that of aluminum alloy. Therefore, when the heater is producing heat, the rotor 14 expands more than the drive shaft 13. This loosens the engagement between the rotor 14 and the shaft 13. However, the rotor 14 is press fitted to the drive shaft 13, and the contact area between the shaft 13 and the rotor 14 is relatively large because of the length of the boss 14*b*. Thus, loosening of the rotor 14 by thermal expansion is not a problem.

In addition to the heating chamber 7, the sub-oil chamber 10 accommodates silicone oil. The heater therefore has sufficient oil to be sheared by the rotor 14. Further, when the heater is operating, silicone oil circulates between the heating chamber 7 and the sub-oil chamber 10. In other words, a portion of the silicone oil is not being sheared at any given moment when the rotor 14 is rotating. This prevents any given part of the silicone oil from being constantly sheared by the rotor 14, thereby preventing premature heat deterioration of the silicone oil.

The term "viscous fluid" in this specification refers to any type of medium that generates heat based on fluid friction when sheared by a rotor. The term is therefore not limited to highly viscous fluid or semi-fluid material, much less to silicone oil.

Therefore, the present examples and embodiments are to be considered as illustrative and not restrictive and the invention is not to be limited to the details given herein, but may be modified within the scope and equivalence of the appended claims.

What is claimed is:

1. A viscous fluid type heater comprising:

a heat chamber for accommodating viscous fluid;

a heat exchange chamber for receiving circulating fluid and being located adjacent to said heat chamber for heat transfer therebetween;

a drive shaft rotatably supported within said heat chamber, said drive shaft being made of a metal having a first heat conductivity; and a rotor mounted on said drive shaft within the heat chamber whereby the rotor rotates and shears the viscous fluid to generate heat which is transferred to the heat exchange chamber thereby heating the circulating fluid passing through the heat exchange chamber, said rotor being made of an aluminum-based metal having a second heat conductivity of at least 100 W/mK which is substantially higher than the first heat conductivity of the drive shaft metal.

2. The heater according to claim 1, wherein said drive shaft metal comprises carbon steel.

3. The heater according to claim 2, wherein said viscous fluid comprises silicone oil.

4. The heater according to claim 3, wherein said rotor further has a boss portion surrounding said drive shaft.

5. The heater according to claim 1, wherein said rotor substantially equalizes the temperatures of the center portion and peripheral portion of the rotor.

6. The heater according to claim 5, wherein said drive shaft metal comprises carbon steel.

7. A viscous fluid type heater comprising:

a heat chamber for accommodating viscous fluid;

a heat exchange chamber for receiving circulating fluid and being located adjacent to said heat chamber for heat transfer therebetween;

a drive shaft rotatably supported within said heat chamber, said drive shaft being made of a metal having a first heat conductivity; and a rotor mounted on said drive shaft within said heat chamber, said rotor shearing the viscous fluid to generate heat whereby the heat is transmitted to the heat exchange chamber thereby heating the circulating fluid passing through the heat exchange chamber, said rotor being made of an aluminum-based metal, wherein said metal of the rotor has a second heat conductivity which is higher than the first heat conductivity, and which substantially equalizes the temperatures of the center portion and peripheral portion of the rotor.

8. The heater according to claim 7, wherein said drive shaft metal comprises carbon steel.

9. A viscous fluid type heater comprising:

a heat chamber and a heat exchange chamber located next to each other, said heat chamber accommodating viscous fluid, said heat exchange chamber accommodating circulating fluid;

a drive shaft rotatably supported within the heat chamber, said drive shaft being made of a metal having first heat conductivity; and a substantially disc shaped rotor rotatably supported on the drive shaft in the heat chamber to shear the viscous fluid and generate heat whereby the heat is transmitted to the heat exchange chamber thereby heating the circulating fluid passing through the heat exchange chamber, said rotor having planar front and back surfaces, both the surfaces contacting the viscous fluid, wherein the rotor is made of material having a second heat conductivity which is higher than said first heat conductivity of the drive shaft, and which substantially equalizes the temperatures of the central portion and the peripheral portion of the rotor.

10. The heater according to claim 9, wherein said material heat conductivity is at least 100 W/mK.

11. The heater according to claim 10, wherein said material comprises a copper-based metal.

12. The heater according to claim 10, wherein said viscous fluid comprises silicone oil.

13. The heater according to claim 12, further comprising a sub-oil chamber in fluid communication with said heat chamber.

14. The heater according to claim 13, wherein said heat exchange chamber comprises a water jacket providing concentrically arranged passages for said circulating fluid on each side of said rotor.

15. A viscous fluid type heater comprising:

a heat chamber accommodating viscous fluid;

a heat exchange chamber for receiving circulating fluid and being located adjacent to the heat chamber for heat transfer therebetween;

a drive shaft rotatably supported by said heat chamber, said drive shaft being made of material which has a first heat conductivity; and a substantially disc shaped rotor mounted on the drive shaft and accommodated in the heat chamber, said rotor being made of a material having a second heat conductivity of at least 100 W/mK which is higher than said first heat conductivity of the drive shaft.

16. The heater according to claim 15, wherein said material comprises an aluminum-based metal.

17. A viscous fluid type heater comprising:

a heat chamber for accommodating viscous fluid, the heat chamber having a stationary wall;

a heat exchange chamber for receiving circulating fluid and being disposed adjacent to said stationary wall of the heat chamber;

a drive shaft rotatably supported within the heat chamber, said drive shaft being made of a metal having a first heat conductivity; and a rotor mounted on the drive shaft and disposed in the heat chamber, said rotor having a radially extending surface which faces said stationary wall of the heat chamber through a gap in which the viscous fluid is received, said radially extending surface shearing the viscous fluid to generate heat, said rotor further having a second heat conductivity so as to substantially equalize the central and peripheral temperatures of the rotor, wherein said second heat conductivity of the rotor is substantially higher than said first heat conductivity of the drive shaft.

18. The heater according to claim 17, wherein the heat conductivity of the rotor is at least 100 W/mK.

* * * * *